United States Patent [19]

Bellagamba

[11] Patent Number: 4,949,974

[45] Date of Patent: Aug. 21, 1990

[54] GOLF TRAINING APPARATUS

[76] Inventor: Miro D. Bellagamba, 13140 Lake Mary Jane Rd., Orlando, Fla. 32832

[21] Appl. No.: 448,078

[22] Filed: Dec. 8, 1989

[51] Int. Cl.[5] ..... A63B 69/36

[52] U.S. Cl. ..... 273/186 R; 273/190 R; 273/188 A

[58] Field of Search ..... 273/191 A, 191 R, 191 B, 273/192, 186 R, 186 C, 187 R, 188 R, 188 A, 190 R

[56] References Cited

U.S. PATENT DOCUMENTS

| | | | |
|---|---|---|---|
| 1,399,761 | 12/1921 | Garland | 273/191 A |
| 3,341,208 | 9/1967 | Marcella | 273/191 A |
| 4,852,881 | 8/1989 | Bellagamba et al. | 273/191 A |

FOREIGN PATENT DOCUMENTS

| | | | |
|---|---|---|---|
| 104225 | 6/1938 | Australia | 273/191 A |

*Primary Examiner*—George J. Marlo
*Attorney, Agent, or Firm*—William M. Hobby, III.

[57] ABSTRACT

A golf training apparatus has a frame having a base for sitting on the ground and a golf club swing guide attached to the frame for guiding a person's swing of a golf club. A guide adjustment system allows for the adjustment of the position of the first golf club swing guide as to both height and tilt of the guide. The frame and swing guides may be made of a PVC (or polyethelene) pipe and may have special PVC attachments utilizing standard PVC couplings. Adjustment are made by telescoping the pipe to the desired position and locking them in place. The swing guide has an arcuate segment and a replaceable connecting segment connecting the ends of the arcuate segment so that the swing guide an be adjusted for size and shape from a complete circle to customized shape for the swing of a golfer.

The frame may have a motor attached thereto and connected to a crank arm mechanism which is coupled to the swing guide for rapidly moving the swing guide during a practice swing. A microswitch is positioned adjacent the swing guide in a predetermined position to actuate the motor to move the swing guide at the predetermined point in the swing pattern.

18 Claims, 4 Drawing Sheets

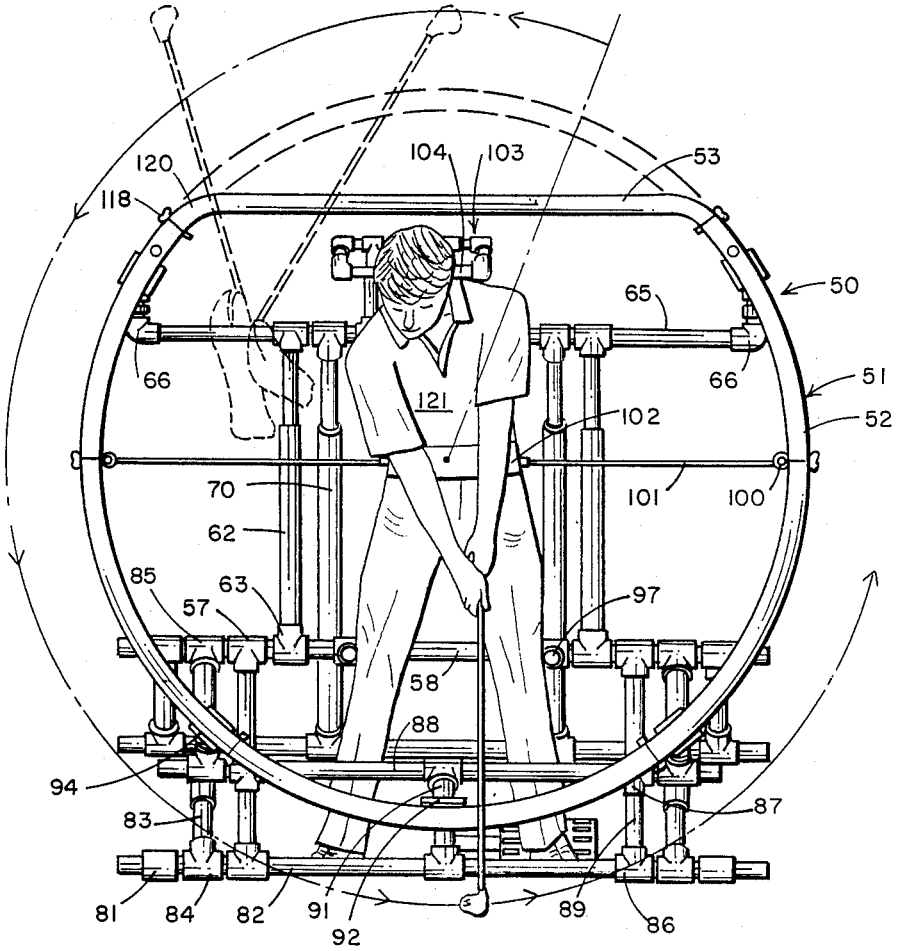
FIG. 3
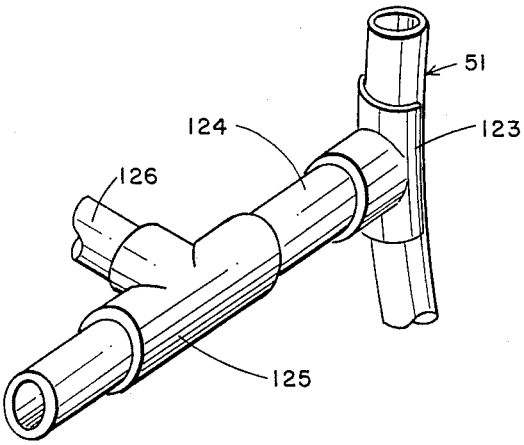
FIG. 7
FIG. 8
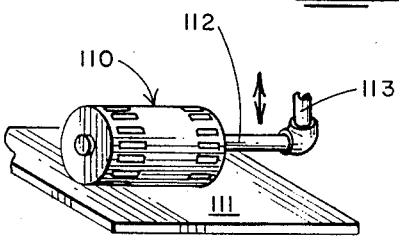

GOLF TRAINING APPARATUS

BACKGROUND OF THE INVENTION

The present invention relates to a golf training apparatus and especially to a golf training apparatus for guiding the swing of a golf club.

Proper striking of a golf ball requires more than a simple swinging motion of the golf club. Numerous factors come into play, any one of which, if improperly executed can cause a poor golf shot. A proper address of the ball by the player, proper grip of the club, proper body position and proper swing of the golf club are four of the key variables that must be correctly executed to achieve a good shot. If, however, the player properly addresses the ball, properly grips the club and assumes the correct body position, an erroneous shot can still result due to improper swing of the golf club. Further in this regard, if one does not swing the golf club properly, the golfer's head can be forced into movement, the club head can be pulled out of proper alignment with the golf ball, the body can be forced into an incorrect position, and the like. Any one of these errors could spell disaster to the shot. It is therefore, quite essential that the player properly swing the golf club. In fact, a properly swung club can force one to meet other criteria that are necessary for the successful golf shot. The correct swing of the golf club is therefore very important to a successful execution of the golf shot whether off the tee, on the fairway, out of a sand trap, or the like.

The ranks of golf professionals, and low handicap amateurs are said to have "grooved" their swings. This statement, of course, refers to the fact that these individuals have mastered a correct swing of the golf club according to their individual physical makeup, so that swinging of the club in the proper manner is a natural reaction. Hence the proper address is made, the club head is smoothly carried away from the ball in the proper arc, properly brought down into engagement with the ball and guided into a proper follow through after striking the ball. Each of these steps are accompanied by proper body action and reaction. In the "grooved" swing, one continually executes these functions as a natural event with a close degree of accuracy whereby a large majority of shots are consistent and predictable.

Throughout golf history, numerous items have been devised to facilitate education or instruction of a golfer in the art of stance, club grip, body movement, swing of the club and the like. In fact, numerous teaching aids have heretofore been devised for instructing one in the proper swing of a golf club. Such devices provide means to compel the individual to swing the club along a predetermined arc or plane. In general, these devices have utilized varying geometric swing paths for both back swing and follow through. A majority of these devices provide a slide or the like, secured to the apparatus and designed to receive a real or simulated club and follow the particular predetermined swing path. Numerous shaped swing paths have been shown in the prior art.

The present invention teaches a swing of a golf club utilizing a combination of methods incorporated into a single multi-purpose swing training system which can guide a swinging club on a swing path different from a circular path to more nearly approximate the correct swing for most individuals and also to adjust for different size clubs without having a variety of different sized training devices.

Typical prior U.S. Patents which are pertinent to the present invention includes the Plunkett et al Pat. No. 2,520,287 which shows a golf club guiding device which captures a golf club and holds it in position for a spiral like swing. The Zega Pat. No. 2,653,025 is for a mechanical golf instruction aid which captures the golf club and holds it for a predetermined swing. The Plunkett et al Pat. No. 2,713,491 is a golf club guiding device for guiding the club in a predetermined manner. The MacStocker Pat. No. 1,960,787 is for a golf club guiding system directing the club around a predetermined swing. The Sciarrillo Pat. No. 4,040,633 is a golf swing training machine supported by a base sitting on an angled surface and guides the golf club on a spiraled pipe guide. The U.S. Patent to Wilson No. 3,794,329 is for a golf teaching apparatus in which the shaft of a golf club is attached to a sleeve which slides on a track to control the swing of a person practicing on the device. The Garland patent teaches an early mechanical golf teaching aid which also slides a shaft in a circular track. In the U.S. Patent to Hightower No. 3,744,799 a golf practice device has a guiding track for teaching the proper technique for swinging a golf club.

In my prior U.S. Pat. No. 4,852,881, for Golf Training Device, dated Aug. 1, 1989, a training apparatus similar to the present invention was made mostly of PVC pipe and included a first circular golf club guide with a second attachable guide for use by smaller golfers. The present invention overcomes some of the limitations and disadvantages of this prior system.

SUMMARY OF THE INVENTION

The present invention relates to a golf training apparatus and especially to an apparatus having a frame with a base for sitting on the ground. An arcuate golf club swing guide is attached to the frame for guiding a person's swing. A guide adjustment system allows for telescoping the frame for adjusting the position of the first club swing guide by adjusting the height, position and angle of the golf club swing guide. The swing guide has an arcuate segment and a replaceable connecting segment connecting the ends of the arcuate segment so that the swing guide can be adjusted for size and shape from a complete circle to a customized swing shape for a particular golfer. The frame may have a motor attached thereto and connected to a crank arm mechanism which is coupled to the swing guide for rapidly moving the swing guide during a practice swing. A microswitch is positioned adjacent the swing guide in a predetermined position to actuate the motor to move the swing guide at the predetermined point in the swing pattern. A person stands in position in the golf training apparatus and swings his club in a backstroke to slide along the golf club guide. The golf club guides can be made of a polymer, such as a polyethelene or PVC, with telescoping frame members for shifting the height and angular position of the arcuate golf club swing guides. Attachments are provided to the frame for a waist stand positioning, and wrist holding position and a foot positioning system so that the body is held in position at the feet and at two positions at the waist. One telescoping member raises and lowers the arcuate golf club guides which can be locked in place with a pin while a second pair of telescoping frame members pushes the bottom portion of the first arcuate golf club swing guide to different positions and a third pair of telescoping frame members are attached to the top portion of the first arcuate golf club swing guide for adjusting the top portion relative to the bottom portion.

BRIEF DESCRIPTION OF THE DRAWING

Other objects, features and advantages of the present invention will be apparent from the written description and the drawings in which:

FIG. 3 is a perspective view of a golf training apparatus in accordance with a second embodiment of the present invention having a golfer positioned therein;

FIG. 7 is a perspective view of a detail of the swing guide coupling;

FIG. 8 is a perspective view of a detail of the motor and a portion of the crank arm.

DESCRIPTION OF THE PREFERRED EMBODIMENT

Figure 1:
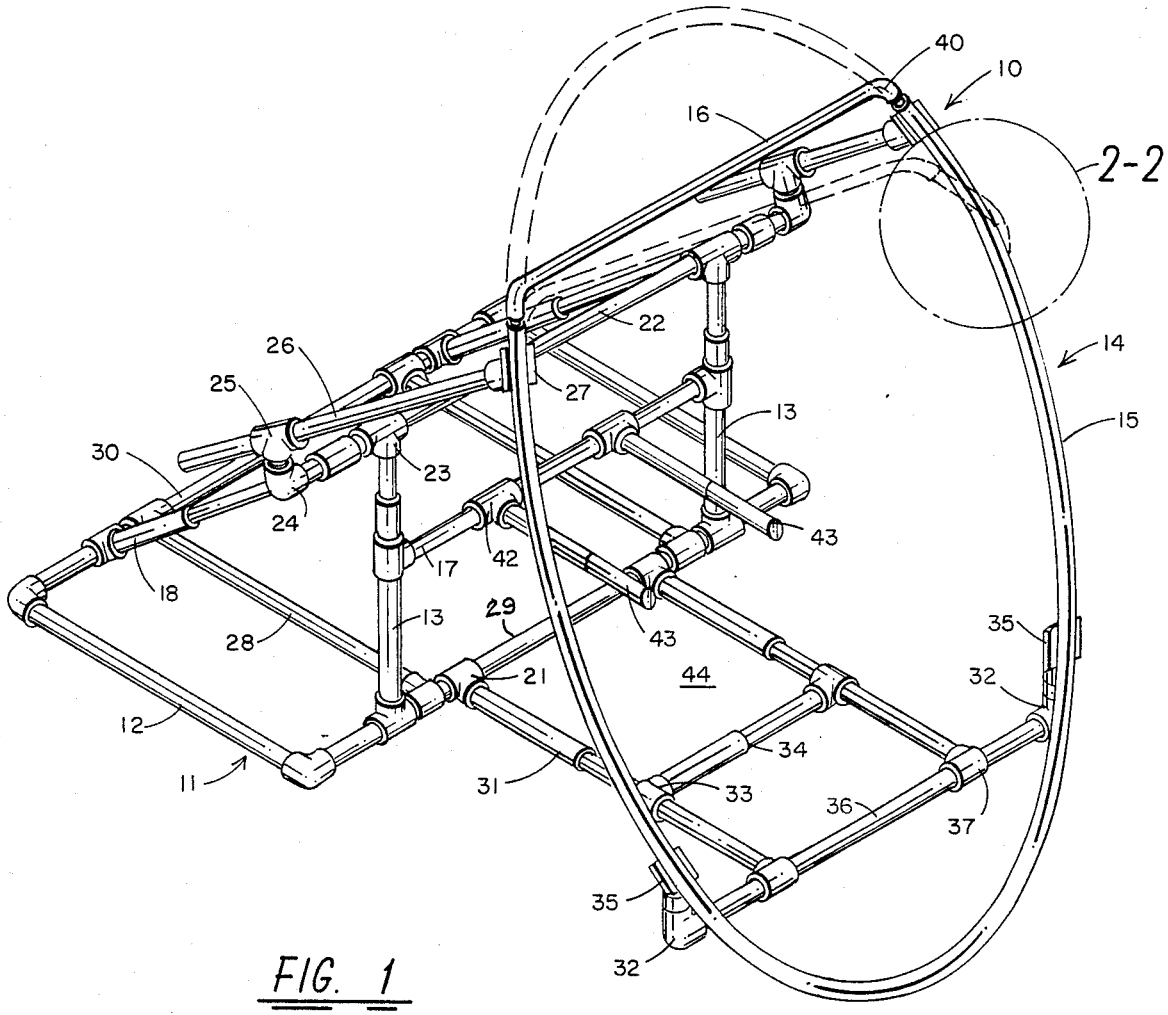
FIG. 1 is a perspective view of a golf training apparatus in accordance with a first embodiment of the present invention having a golfer positioned therein.
Figure 2:
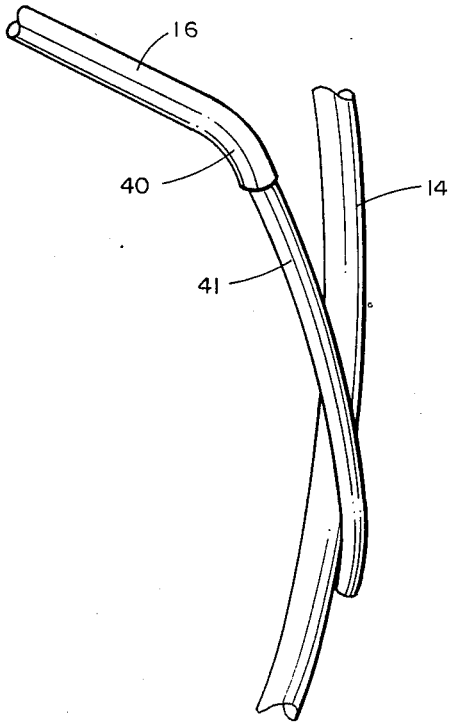
FIG. 2 is a perspective view taken on the circle 2 of FIG. 1.
Figure 4:
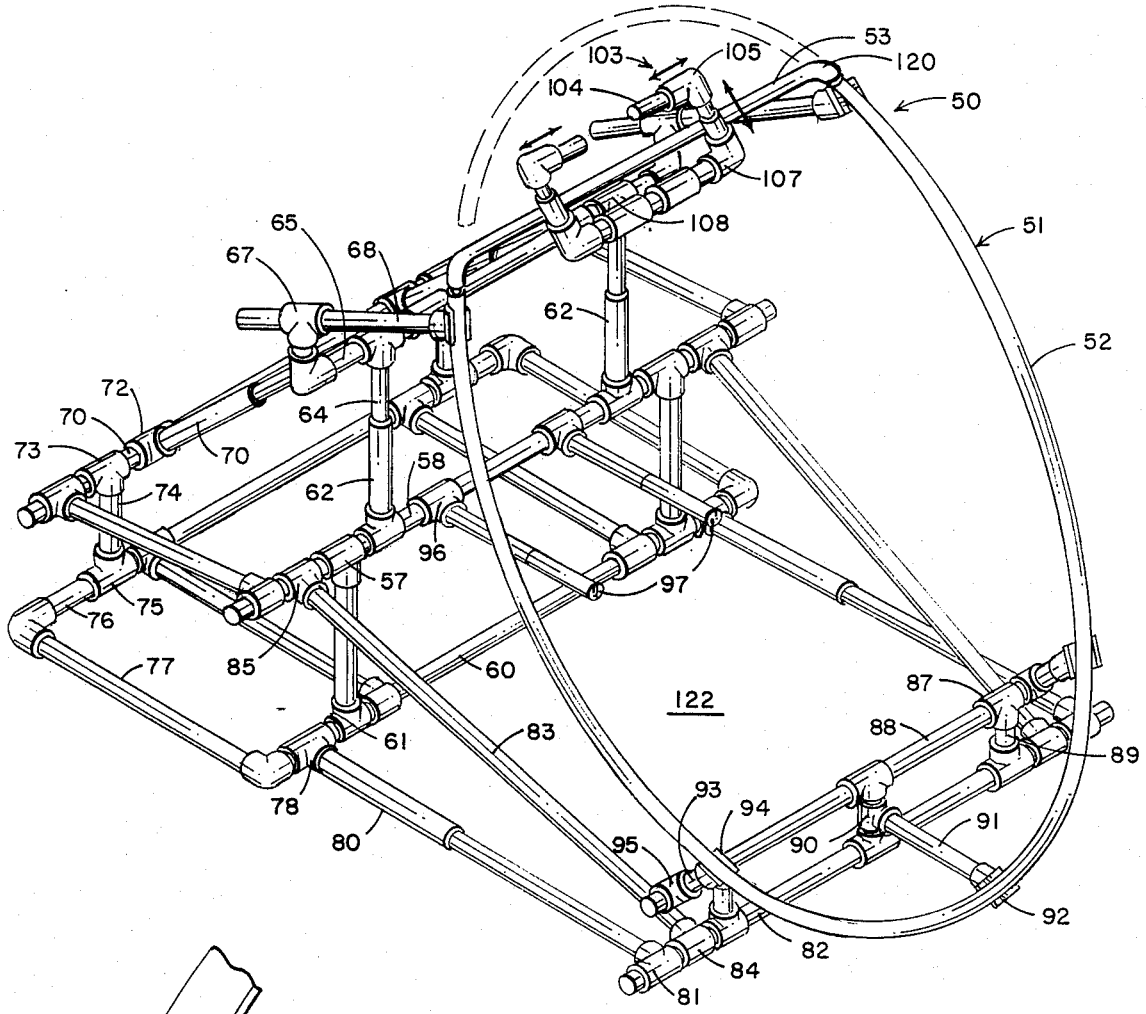
FIG. 4 is a perspective view of a golf training apparatus in accordance FIG. 3 showing the frame and swing guide.

Referring to the drawings and especially to FIGS. 1 and 2, a golf club training apparatus 10 has a frame 11 having a base portion 12 for sitting on the ground and a pair of vertically extending portions 13 extending from the base portion 12. The frame 11 supports a golf club swing guide 14 attached to the frame for guiding the swing of a golfer. The swing guide 14 has an arcuate segment 15 and a replaceable segment 16 which can be rapidly changed to adjust the size of the circle of the swing guide 14 for different size golfers and to reshape the top of the swing guide 14 to conform to a better swing. The swing guide is improved by the segment 16 being of a flattened portion in the arcuate portion 15 thereby flattening one end of what would otherwise be a full circle. In use the golf club is slid along the arcuate swing guide segment 14 during a backstroke until it reaches the segment 16 where the golfer can let his club drop on the back swing.

Frame 11 in addition to the base 12 and vertical members 13 has horizontal frame members 17 connected between the vertical frame members 13. A pair of telescoping angled frame members 18 are connected between the base 11 and the upright vertical members 13 to rigidly support each vertical support frame member 13 in position. Horizontal member 22 connects the top portion of the vertical extending members 13 to a base member 29 through a T-joint 23. Member 22 is coupled to an elbow 24 at each end and supports a T-joint 25 attached to the end of the elbow 24. Each T-joint 25 has a sliding angled support member 26 which supports the swing guide 14 at one end with special coupling members 27. The coupling members 27 resemble a T-joint having a portion removed so that the pipe 15 of the arcuate portion of the swing guide 14 can snap thereinto while remaining out of the way to the smooth slide of a golf club along the swing guide 14. The sliding of members 26 in T-joints 25 allows the swing guide 14 to have the upper surface moved to adjust the tilt of the swing guide 14.

A pair of additional base frame members 28 are connected between a rear support frame member 30 and the horizontal frame member 29. A pair of forwardly extending telescoping base frame members 31 are held at one end to member 29 by a T-joint 21 and to the other end by a T-joint 37 which connects to a horizontal frame member 36. Horizontal frame member 36 has a pair of lower swing guide 14 support brackets 35 similar to the support brackets 27 supported with elbows 32. In addition, the telescoping members 31 have a pair of T-joints 33 in the middle thereof holding a telescoping center frame member 34. When the telescoping slide members 26 are pulled in the T-joints 25, the swing guide 14 can be tilted backward, and the entire swing guide 14 can be shifted forward or backwards by telescoping member 31 at the same time as sliding the members 26 backwards. The guide portion 15 can tilt because the elbows 32 allows the threaded portions connected to frame member 36 to rotate on member 36 thereby slightly threading the elbows 32 in or out.

In operation, the golfer can stand in the areas 44, position the hip positioning members 43 by sliding the T-joints 42 along frame member 17. The golfer can slide members 31 either closer together or further apart with the supporting T-joints 21 on frame member 29 and T-joint 32 or frame member 36 while telescoping member 34 telescopes in and out to position the sides of each of the golfer's shoes. The frame member 34 can then slide on T-joints 33 on frame members 31 to align the golfer's toes.

The segment 16 which is shown as a flattened segment having bent ends 40 is connected as shown in FIG. 2 with a smaller portion 41 sliding into the end of the pipe 14 and having a curvature formed therein so member 16 can be easily removed and replaced with an additional member which can have a flat or arcuate shape as desired and which can be used to adjust the size of the circle formed by the swing guide 14 in order to adjust for different size golfers. The horizontal bar 17 has a pair of T-joints 42 with a pair of protruding telescoping leg guide members 43 extending therefrom into the area 44 where the practice golfer stands and which can indicate where the legs should be positioned for the practice swing.

Turning now to FIGS. 3 through 10, a motorized golf training apparatus 50 is illustrated having a base configuration similar to that of FIGS. 1 and 2 with an adjustable swing guide 51 having an arcuate polymer pipe portion 52 along with a replaceable segment 53 which may be a flattened segment similar to the segment 16 of FIG. 1. The swing guide 51 is supported in a polyethelene or PVC pipe frame 54 having a base 55 made of polymer pipes connected with standard coupling joints and having a central vertical member 56 attached with a T-joint to a horizontal frame member 58 and a second base horizontal frame member 60 with an additional T-joint 61 both of which allow the horizontal bars 58 and 60 to rotate in the couplings 57 and 61. An additional upright member 62 is held by T-joint 63 and has a telescoping portion 64 extending therefrom and supports a horizontal frame member 65 having an elbow coupling 56 and a T-joint 67 on the end thereof. The T-joint 67 has an angled swing guide support arm 68 telescopingly mounted therethrough so that the arm 68 can be slid in the joint 67 to adjust the position of the angle of the swing guide 51. An angled telescoping frame member 70 is held to a horizontal frame member 71 through a T-joint 72 on one end and to the horizontal frame member 65 at the other end. Horizontal frame member 61 is also supported in a pair of T-joints 73 connected to vertical frame member 74 which are mounted in T-joints 75 to the horizontal base frame member 76.

A plurality of generally parallel frame members 77 connect the horizontal base member 76 to the horizontal base member 60 of the frame. Horizontal base member 60 has a pair of T-joints 78 attached thereto having a pair of telescoping members 80 extending forward thereof and attached through T-joints 81 to a front horizontal base frame member 82. In addition, an angled frame member 83 is connected between a T-joint 84 on the cross frame member 82 on one end and through a T-joint 85 to the horizontal frame member 58. Three short vertical frame members 85 are connected on the lower end with T-joints 86 and to the frame member 82 and on the upper end with T-joints 87 to a horizontal frame member 88. The vertical frame member 85 in the center has a T-joint 90 attached thereto holding a support frame member 91 which in turn has a swing guide bracket 92 attached thereto for holding the bottom of the swing guide 51. Similarly, a pair of frame members 93 are attached with brackets 94 to the swing guide 51 and with T-joints 95 to the frame member 88.

A T-joint 96 is attached to the horizontal frame member 58 and has an extending leg guide 97 extending therefrom to position a golfer's leg during a practice section. In addition, as seen in FIG. 3, an eyelet 100 is attached to the swing guide 51 and has a pair of bungee or elastic cords 101 attached thereto and attached to a waist belt 102 to support the golfer's waist. Also, a head positioning portion 103 has telescoping head positioning members 104 sliding in an elbow 105 which is attached to brackets 106 and in turn attached to horizontal member 107 to form a generally C-shape with the members 104 adapted to position a golfer's head. The entire C-shaped head support 103 is supported with a frame member and T-joint 108 which allows the head guide to be rotated on the T-joint 108 and the head positioning members 104 to be positioned for an individual head and which will rapidly slide out of the way by sudden movement of the head.

Figure 5:
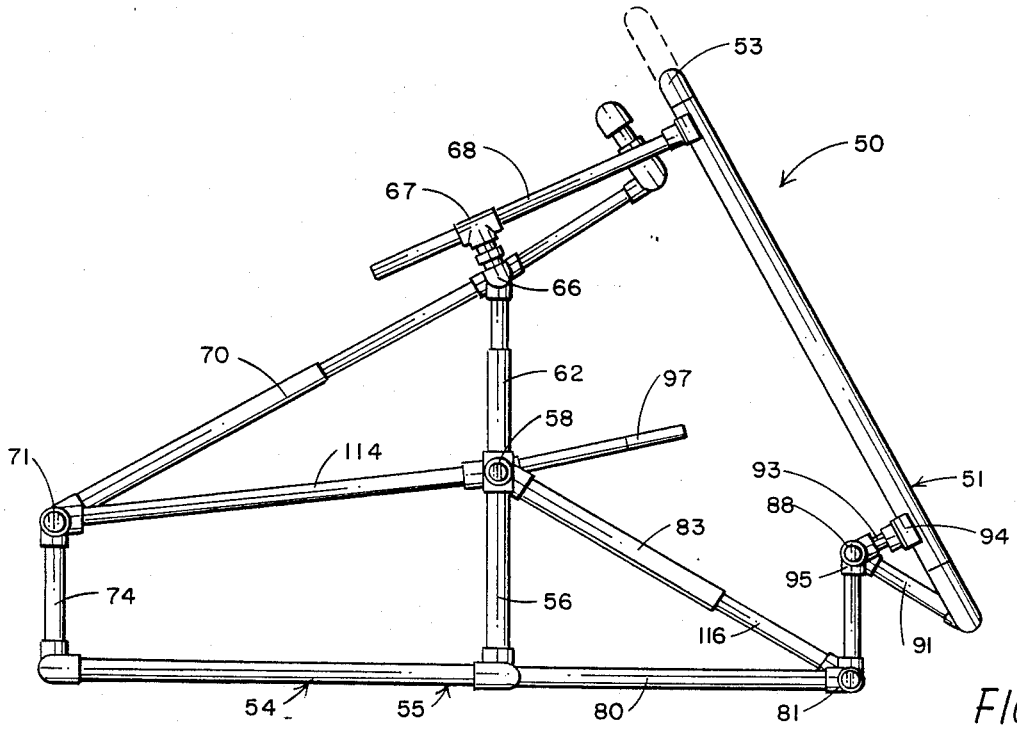
FIG. 5 is a side elevation of a golf training apparatus in accordance FIG. 3 and 4 showing the frame and swing guide.
Figure 6:
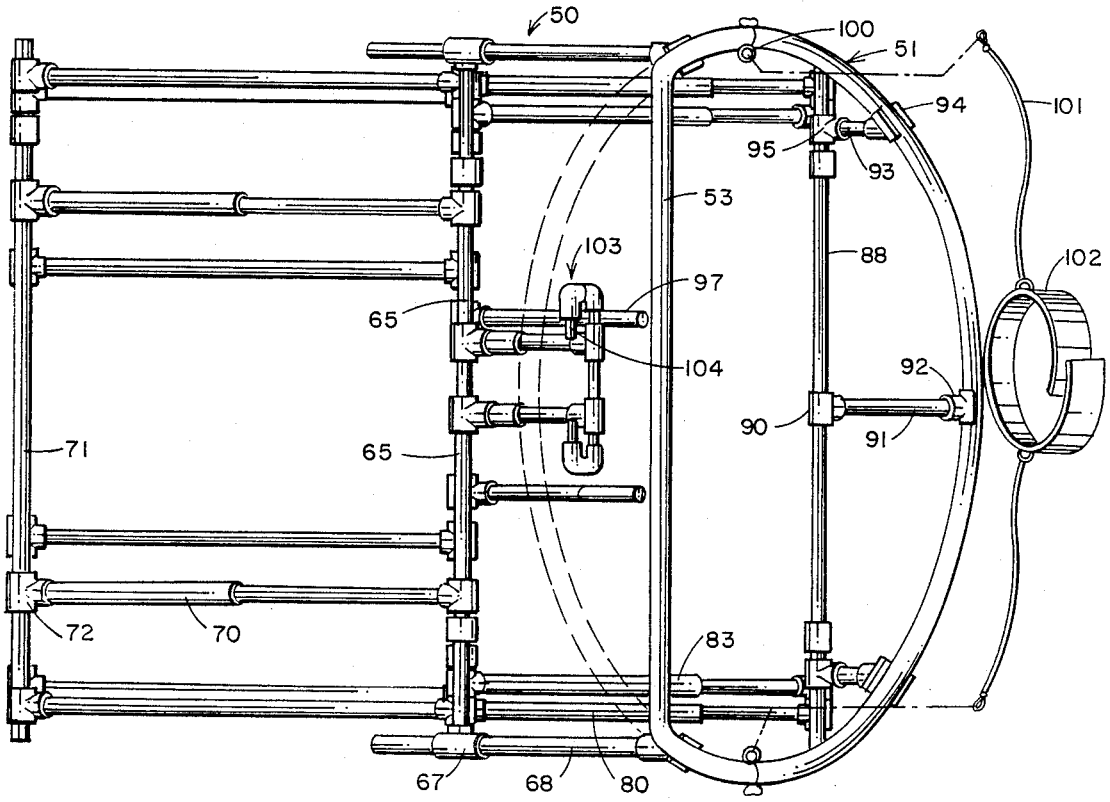
FIG. 6 is a top plan view of a golf training apparatus in accordance FIGS. 3, 4 and 5 showing the frame and swing guide and waist support.

An electric or hydraulic motor 110 can be seen in FIGS. 3 and 8 and is mounted to a base 111 and has a rotating motor shaft 112 attached thereto and a crank arm 113 attached to the shaft 113 and extending perpendicular to form a bell crank mechanism. The bell crank shaft 113 is in turn attached to the horizontal cross member 71 with a T-joint and which member 71 slides therein. Operation of the motor 110, which is a high torque motor, rapidly moves the bell crank arm 113 to move the arm 71 backwards from the position shown in FIG. 5 with the arm 71 sliding in T -joints 75, which slips on the base frame member 76, and also slip on the frame member 71. This movement of the horizontal frame member 71 backwards pulls the angled link member 114 towards the rear along with the telescoping member 70 telescoping from the telescoping arm 115 as seen in FIG. 5. In addition, the vertical frame members 56 and vertical frame members 62 are pulled back at an angle as the horizontal frame member 58 is pulled backwards by the arm 114 as the frame member 70 of the telescoping frame member 83 is slid backward telescoping from the arm 116. This automatically pulls the entire frame portion except the base backwards to suddenly drop the top portion of the swing guide 51 backwards while allowing the bottom portion to rotate with the rotating frame portions 91, 88, and 95.

A microswitch 118 is attached to the top portion 120 of the arcuate swing guide portion 52 towards the end of the practice stroke as shown by the practice golfer 121. The golf club hits the microswitch 118 during the backstroke which in turn activates the motor 110 to rapidly pull the entire swing guide backwards out of the way of the golfer so as to allow the forward swinging of the golf club without interference with the swing guide segment 53.

In operation, the golfer 120 stands in the area 122 of the practice stand 50 as shown in FIG. 3, and attaches the belt 102 with the elastic cords 101, then aligns the head alignment mechanism 103 to position his head in the right position and stands with each leg touching one of the leg positioning guides 97. He can then bring his golf club swing back, as shown in FIG. 3, until it hits the microswitch 118 to actuate the motor to drop the swing guide 51. He can then bring the club forward along without interference from the swing guide.

FIG. 7 illustrates a sample pipe connector for connecting the arcuate swing guide 51 to a bracket 123 which is formed of a T-joint having a portion removed which allows the swing guide 51 to snap thereinto. Bracket 123 is connected by a pipe 124 passing through a T-joint 125 which may be supported in a perpendicular way by a piece of pipe 126.

Figure 9:
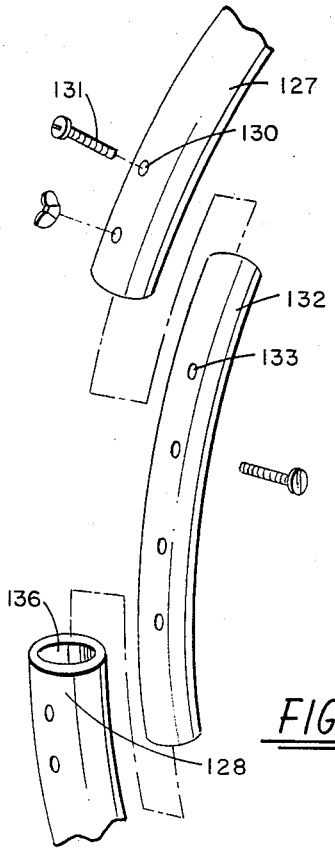
FIG. 9 is an exploded perspective view of the coupling for the swing guide pipe.
Figure 10:
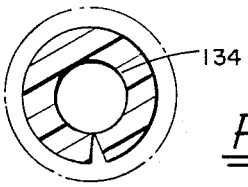
FIG. 10 is a sectional view taken through the coupling of FIG. 9.

FIGS. 9 and 10 illustrate the attachment of the swing guide 51 together in which PVC pipe 127 and 128 have a plurality of openings 130 drilled thereinto for bolts 131 and a smaller segment of pipe 132 has a plurality of openings 133 drilled therein and is slipped into the pipe ends 127 and 128 and is bolted with the bolts 131.

The pipe may be formed as shown in FIG. 10 in which a piece of pipe 134 may be of the same diameter as the pipe 127 and 128 with an elongated notch 135 cut therein which allows the pipe to be squeezed to a smaller size for insertion in the openings 136 so that when the pipe ends 127 and 128 are brought together on top of the pipe section 132 they will form a smooth surface with the bolts 131 mounted to one side so as not to interfere with he guiding the swing of the golf club.

It should be clear at this time that a golf training apparatus has been provided which advantageously allows adjustment of the swing guide for an arcuate path to guide the golf club for different golfers and may have a cut off circle portion connected by a straight pipe segment and, in addition, the golf swing guide may have a high torque motor which will rapidly move the swing guide out of the way of the golf club once the club contacts a microswitch to allow a more natural swing by the controlled action of the shifting of the swing guide. However, the present invention is not to be limited to the forms shown which are to be considered illustrative rather than restrictive.

I claim:

1. A golf training apparatus comprising:

a frame having a base for sitting on the ground;

a golf club swing guide attached to said frame, said golf club swing guide for guiding a person's swing;

guide adjustment means for adjusting the position of said golf club swing guide, said guide adjustment means having a height and angle adjustment for said golf club swing guide; and said golf club swing guide having an arcuate polymer pipe segment having a replaceable connecting segment connecting the ends of said arcuate pipe segment to thereby vary the swing guide from a complete circle and customize the swing guide for the practice swing of a golfer.

2. A golf training apparatus in accordance with claim 1 in which said golf club swing guide forms a partial circle having a generally horizontal segment formed by said replaceable connecting segment.

3. The golf training apparatus in accordance with claim 2 in which said frame base includes a pair of slidable frame members and foot guides positioned between a pair of generally perpendicular frame base members, whereby said pair of sliding frame members can be positioned to locate a golfer's shoes.

4. A golf training apparatus in accordance with claim 3 in which said slidable frame member foot guides are telescoping frame members connecting the frame base with the bottom portion of said golf club swing guide.

5. A golf training apparatus in accordance with claim 4 including a toe guide connected between said pair of slidable frame member foot guides and slidably thereon to position the toe of a golfer's shoe.

6. A golf training apparatus in accordance with claim 5 in which said toe guide is a telescoping pipe member.

7. A golf training apparatus in accordance with claim 6 including a waist band attachment attached to said frame and having a removable waist band.

8. A golf training apparatus in accordance with claim 7 in which said frame has a pair of vertically extending telescoping members for adjusting the height of said golf club swing guides.

9. A golf training apparatus in accordance with claim 8 in which said guide adjustment means has a pair of angled rear members attached to said golf club swing guide along the top portion thereof and telescoping on said frame to move said golf club swing guide relative to said frame.

10. A golf training apparatus in accordance with claim 6 in which said frame has a pair of telescoping leg positioning arms slidably attached to a horizontal frame member for positioning a golfer's legs during practice swings.

11. A golf training apparatus comprising: a frame having a base for sitting on the ground;

a golf club swing guide attached to said frame, said golf club swing guide for guiding a person's swing;

guide adjustment means for adjusting the position of said golf club swing guide, said guide adjustment means having a height and angle adjustment for said golf club swing guide;

said golf club swing guide having an arcuate polymer pipe segment having a replaceable connecting segment connecting the ends of said arcuate pipe segment to thereby vary the swing guide from a complete circle and customize the swing guide for the practice swing of a golfer; and said frame having a motor attached thereto and connected to an arm, and said arm coupled to said golf club swing guide whereby said golf club swing guide can be moved between positions by actuating said motor.

12. A golf training apparatus in accordance with claim 11 including a micro-switch positioned adjacent said golf club swing guide for actuation by a practice backstroke swing of a golf club on said swing guide, said micro-switch being coupled to said motor to actuate said motor when said switch is actuated to move said golf club swing out of the way of the forward stroke of the golfer.

13. A golf training apparatus in accordance with claim 12 in which said arm coupled to said motor is connected to a first transverse frame member and a pair of frame members are connected between said first transverse frame member and a second transverse frame member supporting said club swing guide whereby said arm moves said first transverse frame member which in turn moves said second transverse frame member and one side of said swing guide circle.

14. A golf training apparatus in accordance with claim 13 including third transverse frame member and connecting arms for first transverse frame member and said second transverse frame member to provide a collapsing action to drop a portion of said swing guide.

15. A golf training apparatus in accordance with claim 14 in which said golf club swing guide forms a partial circle having a flattened segment formed by said replaceable connecting segment.

16. A golf training apparatus in accordance with claim 15 including a waist band attachment attached to said frame and having a removable waist band.

17. A golf training apparatus in accordance with claim 16 in which said frame has a pair of vertically extending telescoping members for adjusting the height of said golf club swing guide.

18. A golf training apparatus in accordance with claim 17 in which said guide adjustment means has a pair of angled rear members attached to said golf club swing guide along the top portion thereof and telescoping on said frame to move said golf club swing guide relative to said frame.

* * * * *